US009066844B2

(12) United States Patent
Thiebaut

(10) Patent No.: US 9,066,844 B2
(45) Date of Patent: Jun. 30, 2015

(54) DEVICE FOR MASSAGING THE SKIN

(75) Inventor: Laure Thiebaut, Clichy (FR)

(73) Assignee: L'Oreal, Paris (FR)

( * ) Notice: Subject to any disclaimer, the term of this patent is extended or adjusted under 35 U.S.C. 154(b) by 1305 days.

(21) Appl. No.: 11/958,128

(22) Filed: Dec. 17, 2007

(65) Prior Publication Data

US 2008/0154162 A1 Jun. 26, 2008

Related U.S. Application Data

(60) Provisional application No. 60/884,239, filed on Jan. 10, 2007.

(30) Foreign Application Priority Data

Dec. 15, 2006 (FR) ..... 06 55555

(51) Int. Cl.
*A61H 15/00* (2006.01)
*A61H 15/02* (2006.01)
(Continued)

(52) U.S. Cl.
CPC ..... *A61H 15/02* (2013.01); *A45D 34/04* (2013.01); *A61H 7/003* (2013.01); *A61H 15/0092* (2013.01); *A61H 2015/0014* (2013.01); *A61H 2201/0153* (2013.01); *A61H 2201/105* (2013.01); *A61H 2201/1604* (2013.01); *A61H 2205/022* (2013.01)

(58) Field of Classification Search
CPC ..... A61H 7/00; A61H 7/001; A61H 7/002; A61H 7/003; A61H 15/00; A61H 15/02; A61H 15/0078; A61H 15/0092; A61H 2015/0035; A61H 2201/105; A61H 2201/1669; A61H 2201/0207; A61H 2201/0228
USPC ..... 601/6, 7, 9, 10, 15, 17–19, 84, 87, 93, 601/97, 99, 112, 113, 122, 123, 125, 126, 601/128, 129, 130, 136–138; 401/208, 401/218–220
See application file for complete search history.

(56) References Cited

U.S. PATENT DOCUMENTS 1,539,299 A * 5/1925 Cheney ..... 601/20
1,595,324 A * 8/1926 Van Sant ..... 401/28
(Continued)

FOREIGN PATENT DOCUMENTS

EP 0 465 348 1/1992
EP 0 673 635 9/1995
(Continued)

OTHER PUBLICATIONS

Translation of FR2440735A attached.*

*Primary Examiner* — Justine Yu
*Assistant Examiner* — Christopher Miller
(74) *Attorney, Agent, or Firm* — Oblon, McClelland, Maier & Neustadt, L.L.P.

(57) ABSTRACT

A massage device intended to be applied to the skin of a user. The massage device may include a body, at least one massage member that is fixed relative to the body, and at least one massage member that can rotate relative to the body when moved over the skin in contact therewith. At least part of the fixed massage member in contact with the skin is able to move following the path of at least part of the mobile massage member in contact with the skin so as to cause at least one skin fold to be formed between the said massage members as the device is moved around.

20 Claims, 15 Drawing Sheets

(51) Int. Cl.
*A61H 7/00* (2006.01)
*A45D 34/04* (2006.01)

(56) References Cited

U.S. PATENT DOCUMENTS

| | | | | | |
|---|---|---|---|---|---|
| 1,958,936 | A | * | 5/1934 | Bajette et al. | 601/73 |
| 2,438,249 | A | * | 3/1948 | Mattison | 601/122 |
| 2,574,601 | A | * | 11/1951 | Swanson | 601/7 |
| 2,638,089 | A | * | 5/1953 | Murphy | 601/27 |
| 2,748,763 | A | * | 6/1956 | Kosloff | 601/131 |
| 2,988,084 | A | * | 6/1961 | Douglas | 601/80 |
| 3,292,614 | A | * | 12/1966 | Fleming | 601/122 |
| 3,672,358 | A | * | 6/1972 | Majewski | 601/132 |
| 3,756,224 | A | * | 9/1973 | Laymon | 601/125 |
| 4,326,508 | A | * | 4/1982 | Stauffer | 601/129 |
| 4,813,404 | A | * | 3/1989 | Vallis | 601/125 |
| 4,823,777 | A | * | 4/1989 | Goncalves et al. | 601/154 |
| 4,858,600 | A | | 8/1989 | Gross et al. | |
| 5,090,402 | A | * | 2/1992 | Bazin et al. | 601/17 |
| 5,125,757 | A | * | 6/1992 | Morrison et al. | 401/21 |
| 5,131,384 | A | * | 7/1992 | Obagi | 601/131 |
| 5,218,955 | A | * | 6/1993 | Gueret | 601/123 |
| 5,311,860 | A | * | 5/1994 | Doria | 601/103 |
| 5,673,455 | A | * | 10/1997 | Per-Lee et al. | 15/210.1 |
| 5,792,081 | A | * | 8/1998 | Cross | 601/123 |
| 5,961,235 | A | * | 10/1999 | Kennedy | 401/6 |
| 6,129,469 | A | * | 10/2000 | Messer et al. | 401/6 |
| 6,203,509 | B1 | * | 3/2001 | Duboff | 601/70 |
| 6,245,031 | B1 | * | 6/2001 | Pearson | 601/118 |
| 6,702,766 | B2 | | 3/2004 | Guitay | |
| 6,925,672 | B1 | * | 8/2005 | Bromley | 15/104.94 |
| 6,939,072 | B2 | * | 9/2005 | Thiebaut | 401/266 |
| 7,083,581 | B2 | * | 8/2006 | Tsai | 601/15 |
| 7,168,873 | B2 | * | 1/2007 | Shawan et al. | 401/6 |
| 2004/0254508 | A1 | * | 12/2004 | Lee | 601/119 |
| 2005/0020948 | A1 | * | 1/2005 | Gueret | 601/122 |
| 2005/0251071 | A1 | * | 11/2005 | Zhadanov et al. | 601/136 |
| 2006/0111654 | A1 | * | 5/2006 | Mizuuchi | 601/104 |
| 2006/0276730 | A1 | * | 12/2006 | Thiebaut et al. | 601/112 |
| 2007/0066919 | A1 | * | 3/2007 | Gueret | 601/138 |
| 2007/0173749 | A1 | * | 7/2007 | Williams et al. | 601/123 |
| 2007/0249975 | A1 | * | 10/2007 | Pan et al. | 601/118 |
| 2009/0270772 | A1 | * | 10/2009 | Kurosu | 601/19 |

FOREIGN PATENT DOCUMENTS

| | | | | |
|---|---|---|---|---|
| EP | 673635 | A1 | * | 9/1995 |
| FR | 804578 | | | 10/1936 |
| FR | 934070 | | | 5/1948 |
| FR | 2440735 | A | * | 7/1980 |
| FR | 2 664 158 | | | 1/1992 |
| FR | 2 809 952 | | | 4/2003 |
| FR | 2 883 161 | | | 9/2006 |
| GB | 330461 | | * | 6/1930 |

* cited by examiner

DEVICE FOR MASSAGING THE SKIN

CROSS-REFERENCE TO RELATED APPLICATIONS

This document claims priority to French Application Number 06 55555, filed Dec. 15, 2006 and U.S. Provisional Application No. 60/884,239, filed Jan. 10, 2007, the entire contents of which are hereby incorporated by reference.

BACKGROUND OF THE INVENTION

1. Field of the Invention

The present invention relates to the massaging of tissues of a part of a user's epidermis that is to be treated. The present invention also relates to the penetration of a cosmetic formula or of a care formula into the skin. More specifically, the invention relates to a device that can be used to massage locally the epidermis of a user. The device can also be used, for example, to encourage a cosmetic or care formula to penetrate the upper layers of an area being massaged.

2. Discussion of Background

U.S. Pat. No. 4,858,600 describes a massage gadget which includes a rotary container filled with a cosmetic product and a collection of balls housed in an end wall of the container. When the container is turned, the balls are given a rotational movement in a circular path. As the described gadget is applied to the face of a user, the balls also rotate on themselves and apply the product contained in the container while at the same time massaging the epidermis. A gadget such as this does not achieve a very effective massaging action. This is because the balls of the gadget essentially act to compress the skin.

To obtain satisfactory massage, it can be beneficial not only to obtain an effect whereby the skin is compressed, but also to obtain an effect of separation in order in particular to fight against the sagging of the tissue of the epidermis. To do this, FR-B-804 578 describes a massage device which includes a gripper provided with a rotary roller and each of its free ends and which when closed, allows part of the epidermis against which the rollers press to be lifted up. Because of its design, this device has the major disadvantage of squeezing the user's skin tightly as the rolls are brought closer to one another. This being the case, the massage may prove particularly unpleasant for the user.

FR-A-2 664 158 describes a gadget for massaging the skin which is provided with a body and with two rollers mounted to rotate on the body. The rollers are arranged on this body in such a way that only a peripheral region of each roller comes into contact with that part of the epidermis that is to be massaged. As a result, the size of the region massaged is dependent essentially upon the lateral spacing between the rollers. This massage gadget therefore has the major disadvantage of being relatively large in size.

FR 2 883 161 and FR 2 809 952 describe a massage gadget that includes rollers that make the gadget easier to move over the skin of the user and which at least in part delimit a chamber which is connected to a pneumatic vacuum source in order, through suction, to form at least one skin fold. A gadget such as this has the major disadvantage of entailing the use of a pneumatic means in order to form skin folds. This appreciably increases its cost price.

SUMMARY OF THE INVENTION

In the light of the foregoing, one object of the present invention is to remedy the disadvantages of the earlier massage gadgets. For example, one object of the invention is to provide a compact device suited to massaging the surface of the epidermis of a user in a more effective way, which is nice and pleasant to use. Another object of the present invention is to provide a massage device that allows skin folds to be created by purely mechanical means.

A subject of the invention, according to one of its aspects, is a massage device intended to be applied to the skin and including a body, at least one massage member that is fixed relative to the body, and at least one massage member that can rotate relative to the body when moved over the skin and in contact therewith.

According to a preferred example, the mobile massage member has reliefs. At least part of the fixed massage member in contact with the skin is able to move following the path of at least part of the mobile massage member in contact with the skin so as to cause at least one skin fold to be formed between the massage members as the device is moved around.

The expression "fixed massage member" as used herein is intended to denote an element which, overall, maintains a fixed position with respect to the body as the device is moved around. The expression "reliefs" as used herein is intended here to denote means which project from the exterior surface of the mobile massage member and which constitute massage surfaces intended to come into contact with the user's skin.

At least part of the fixed massage member can be arranged so as to lie facing at least part of the mobile massage member with respect to a direction in which the device is moved around. As noted above, at least part of the fixed massage member can be arranged to follow a path of at least part of the mobile massage member. In this example configuration, the part of the fixed massage member in contact with or in engagement with the skin is projected, along the line of travel of the device, on to at least part of the mobile massage member that can move in contact with the skin. This configuration can allow an area of skin to be trapped between the two massage members with respect to the direction in which the device moves.

Because the fixed massage member has a tendency to move this region of skin in the direction of travel of the device, whereas the mobile massage member with the reliefs has a tendency to move this region of the skin in the opposite direction, the skin trapped between the two massage members forms a skin fold when the fixed massage member lies behind the mobile massage member with respect to the direction of travel of the device. Thus it can be possible to obtain a compact device that is particularly well suited to massaging the epidermis of the face or body of a user and which can be particularly effective. In this example, a skin fold can be obtained by compressing and separating the skin using mechanical means, and there is no need to provide additional suction means that add to the cost.

According to an example, the reliefs run axially over the external surface of the mobile massage member with respect to an axis of rotation of the massage member. The reliefs can be spaced apart in the circumferential direction on the external surface of the mobile massage member. The existence of raised elements combined with the use of a massage member that is fixed in its entirety relative to the body can allow a skin fold to be created between the fixed massage member and a row of raised elements provided on the exterior surface of the mobile massage member. The skin fold thus created can then be released when the mobile massage member continues to turn, and a further fold can be created when the very next row of raised elements arrives. In other words, a plurality of skin folds can be created as the device is moved around by virtue of the use of reliefs on the mobile massage member. This exemplary aspect can improve the effectiveness of the massage, particularly over a device with plain massage members that is not able to release the skin fold created but only to move around the fold created in conjunction with the movement of the device.

According to another exemplary aspect, the massage members can have an elongated overall shape. In this example, a mobile massage member and a fixed massage member can be arranged such that a longitudinal edge of the fixed massage member faces a longitudinal edge of the mobile massage member so as to cause a skin fold to be formed between the massage members. The fixed and mobile massage members each having an elongated overall shape combined with a longitudinal edge of one of the massage members lying facing a longitudinal edge of the other massage member can make it possible, by compression and separation, to create a skin fold which is substantially equal to the length of these elements.

According to another exemplary aspect the invention, the fixed massage member and the mobile massage member extend along a first axis and a second axis respectively, the axes being substantially mutually parallel. This configuration can yield particularly effective massaging with a device of a small size.

According to another example, the device includes a fixed massage member mounted between two mobile massage members. The device can include other features as well. For example, in one exemplary aspect, the device further includes a reservoir filled with a product, for example a cosmetic product. The reservoir can also act as a support for the body of the device. In other words, the body of the device can be mounted on the reservoir.

In a further example, one of the massage members includes a product outlet orifice. Advantageously, the fixed massage member can include at least the product outlet orifice. Having an outlet orifice formed on the fixed massage member can be particularly advantageous insofar as it makes it possible to cause the product to flow directly against the user's epidermis in a particularly simple way. According to another exemplary aspect of the invention, the device can further include a closure cap mounted on the body. Advantageously, the cap can includes a pin for closing off the product outlet orifice.

As an example, the body and the fixed massage member can be made as one piece. Thus, these two elements can be obtained by moulding a plastic, such as a polyamide, a polypropylene or, alternatively, a polyethylene.

Another exemplary aspect of the present invention relates to a method for massaging the skin using a device as described hereinabove. For example, a skin fold can be created solely by pressing a fixed massage member onto a region of the skin which can tend to cause a region of the skin to move in the direction of travel of the device, and by rotating a mobile massage member which, on account of the reliefs, can cause this region of the skin to move in the opposite direction to the direction of travel of the device. In this example method, skin folds are created by exclusively mechanical means, without providing additional, for example pneumatic, means.

As should be apparent, the invention can provide a number of advantageous features and benefits. It is to be understood that, in practicing the invention, an embodiment can be constructed to include one or more features or benefits of embodiments disclosed herein, but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

A better understanding of the invention will be gained from reading the following description in conjunction with the accompanying figures. The figures are offered purely as a guide and by way of example, and in no way limit the invention.

DETAILED DESCRIPTION OF THE PREFERRED EMBODIMENTS

Figure 1:
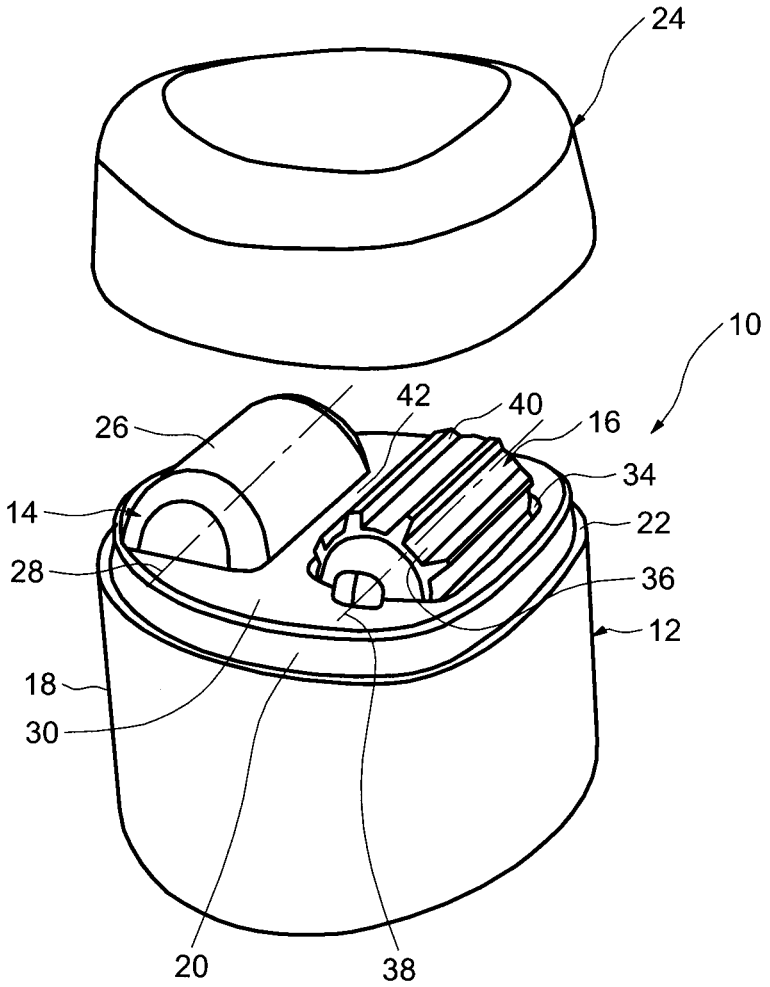
FIG. 1 is a perspective depiction of an example massage device.

Referring now to the drawings, like reference numerals are utilized to designate identical or corresponding parts throughout the several views.

The figures depict the overall structure of a massage device according to exemplary aspects of the invention, denoted by the general numerical reference 10. The massage device 10 is intended to be used to massage the epidermis of a user and, for example, to massage his or her face, in order to combat the sagging of the tissues of the epidermis. The device 10 can, as appropriate, be used to encourage a cosmetic or care composition already applied or contained in the device to penetrate the skin.

Figure 2:
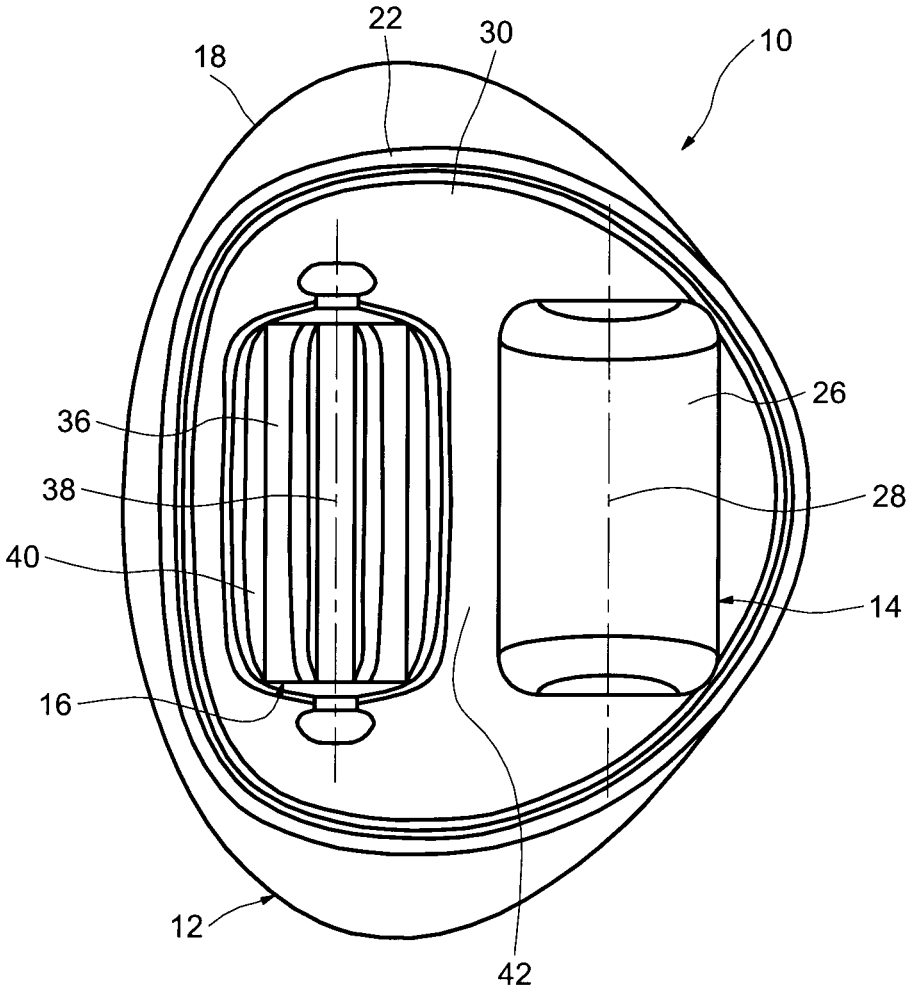
FIGS. 2 and 3 are side and plan views, respectively, of the example device of FIG. 1.
Figure 3:
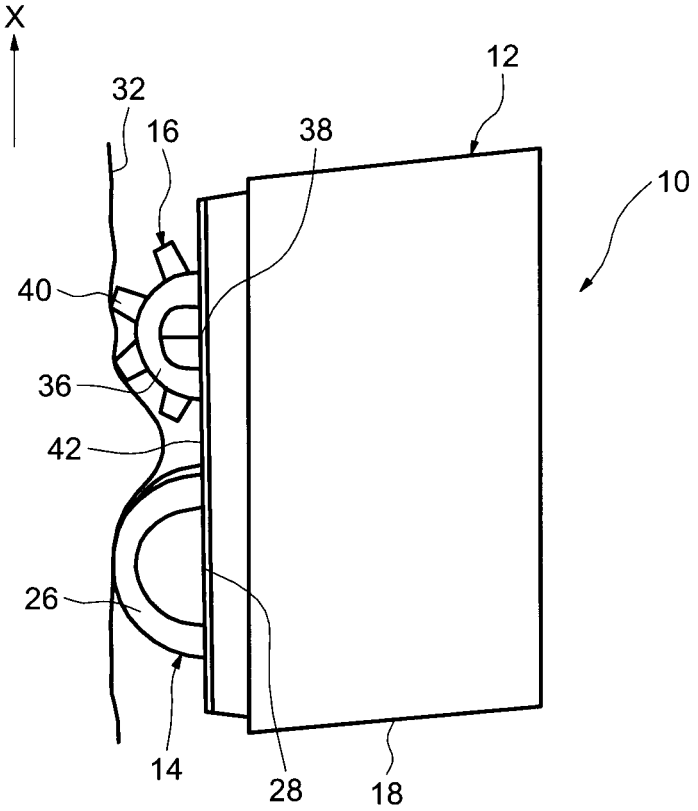
Figure 4:
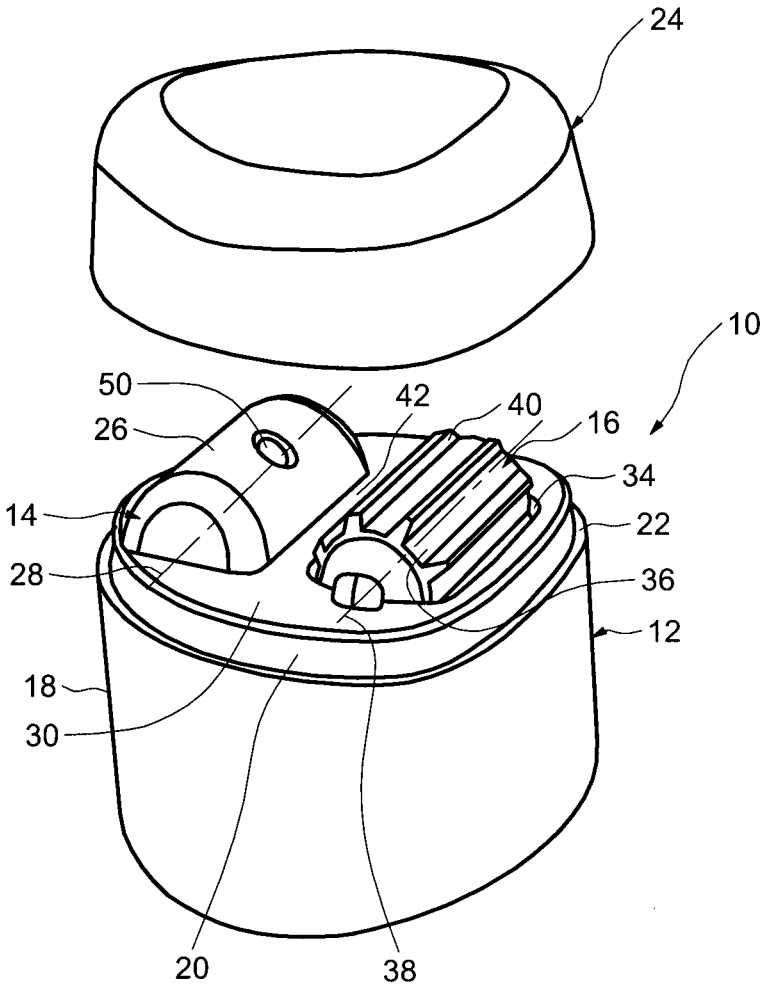
FIG. 4 is a perspective depiction of a second example massage device.

As illustrated in the exemplary depiction in FIGS. 1 to 3, the device 10 can include a body 12 of elongated overall shape, which can be directed vertically, and massage members 14, 16 mounted on the body 12. As an example, the body 12 can be provided with a base 18 designed to allow a user to hold the device 10 against the palm of his or her hand, and with an upper end portion 20 that forms a shoulder 22 onto which a cap 24 (as can be seen in FIG. 4) can be mounted to close or shut off the device 10. The closure cap 24 can be designed to clip, or be mounted by any other appropriate means, onto the end portion 20 of the body 12.

The massage member 14 is mounted fixedly with respect to the body 12. The entire massage member 14 can be fixed in its entirety relative to the body 12, as the device 10 is moved around. In this example, the massage member 14 adopts the form of a half roller 26 fixed across an upper frontal surface 30 of the end portion 20. The half roller 26 or half cylinder extends longitudinally along an axis 28. The axis 28 is the axis of the geometric cylinder that defines the half-roller 26.

In this example, the half-roller 26 is positioned on the frontal surface 30 in such a way as to project with respect to this surface. The projection of the half-roller 26 can thus be pressed against the skin 32 of a user as illustrated in FIG. 3. That portion of the exterior surface of the half-roller 26 that is intended to be in contact with the skin 32 thus constitutes a massage surface of the massage member 14. In the example illustrated, the half-roller 26 is in the form of a half cylinder of revolution. However, it will be readily appreciated that it is equally possible to envision other shapes, for example an elliptical shape.

The massage member 14 in this example is fixedly attached to the frontal surface 30 of the body 12. In a different example, it is possible to have the body 12 and the massage member 14 formed as one, for example by moulding a synthetic material, in order to obtain a particularly economical device. As an alternative, it is even possible to obtain the massage member 14 by overmoulding a flexible synthetic material such as rubber, silicone or alternatively Santoprene® onto the body 12.

In order allow the massage member 16 to be partially held inside the body 12, the frontal surface 30 can include a recess 34. Specifically, the massage member 16 in this example is produced in the form of a roller 36, of axis 38, which at each end has journals (unreferenced) intended to fit into housings provided for this purpose at the frontal surface 30. The roller 36 in this example is produced in the form of a cylinder of revolution. The roller 36 can be mounted to rotate on the body 12 about the axis 38 which lies more or less at the frontal surface 30. The axis 38 in this example is substantially parallel to the axis 28 of the half-roller 26 of the massage member 14.

On its exterior surface, the roller 38 has reliefs that are, in this example, produced in the form of ribs 40 which extend axially over its entire length. The ribs 40 can be spaced apart in the circumferential direction. The circumferential spacing of the ribs 40 can be uniform. They constitute a massage surface of the massage member 16 which projects from the surface 30.

As is depicted more visibly in FIG. 2, the axial dimensions of the half-roller 26 of the massage member 14 and of the roller 38 of the massage member 16 can be substantially equal. Furthermore, the massage members 14, 16 can be mounted on the frontal surface 30 of the body 12 in such a way that their free ends are substantially aligned. The space occupied by the massage members 14, 16 in this example is circumscribed inside the main cross section of the surface 30. In other words, the massage members of this example do not project beyond the peripheral edge of the surface 30.

The massage member 14 is positioned relative to the massage member 16 in such a way as to delimit a space 42. Each of the massage members 14, 16 in this example include an elongated overall shape. What is meant here by an elongated overall shape is an element that has an axial dimension appreciably greater than its radial dimension and which, in cross section, can arbitrarily have a cross section that is round, oval, etc.

As indicated above, in this example, the axis 28 of the fixed massage member 14 is substantially parallel to the axis 38 of the mobile massage member 16. Thus, a longitudinal edge of the massage member 14 faces a longitudinal edge of the massage member 16, and the distance separating the edges being kept constant.

As an example, when using the device 10, the user presses the ribs 40 that constitute the massage surfaces of the roller 36 of the massage member 16 and the half-roller 26 of the massage member 14 against that part of the skin 32 that is to be massaged, and moves the device 10 in a translational movement in the direction X (FIG. 3) perpendicular to the axes 28 and 38. The exterior surface of the half-roller 26 of the fixed massage member 14 that forms a massage surface exerts pressure on a region of the skin, and this tends to cause this region of the skin to move in the direction X of travel of the device. At the same time, one of the ribs 40 of the massage member 16 which is rotated about the axis 38 tends to move this region of the skin in the opposite direction to the direction X of travel. This region of the skin is thus stretched out in two opposing directions.

The region of the skin sandwiched between the massage members 14, 16 thus has a tendency to move in the direction of the space 42 in the direction tangential to the direction X of travel of the device. Thus, the action of the mobile massage member 16 combined with that of the massage member 14 can make it possible to create a skin fold between the half-roller 26 and one of the ribs 40 of the roller 36. As the roller 36 continues to turn, the skin fold thus formed can be released and then another fold can be formed when the immediately next rib 40 arrives. This then can be a particularly effective way of compressing the skin and of introducing a separation effect between the massage members 14, 16 in respect of each of the skin folds created in turn.

Furthermore, in this example, the length of skin compressed and separated between the members as the device 10 is passed over the skin is relatively large given that this length equates to the axial dimension of the half-roller 26 and of the roller 28. In addition, given the constant spacing between the fixed massage member 14 and the mobile massage member 16, the massage effect can be uniform for the entire area being massaged.

In another example, it is possible to have the axes 28 and 38 at a slight angle with respect to one another, this angle for example being between 0 and 20°. However, the applicant has determined that the massage effect is more satisfactory when the axes 28 and 38 are parallel.

It will be noted that, in operation, the half-roller 26 of the fixed massage member 14 can press against the skin to push it towards the space 42 formed between the first massage member 14 and the second massage member 16. In this respect, it is possible to make provision for the half-roller 26 to have a massage surface that has roughnesses and/or is made of a relatively rough material, such as rubber, silicone or alternatively Santoprene®.

The example illustrated in FIG. 4 differs in that the half-roller 26 of the massage member 14 that is fixed with respect to the body 12 further includes a product dispensing orifice 50 formed at its exterior surface that constitutes the massage surface. Specifically, in this example form, the body 12 includes a reservoir (not depicted) mounted inside the base 18 and advantageously filled with a cosmetic or care composition. The dispensing orifice 50 can be in fluidic communication with the reservoir through any of a variety of methods readily discernible by one of ordinary skill in the art.

In this example, when the device 10 is applied to the skin in order to massage part of the epidermis of a user, it is possible at the same time for some of the cosmetic composition contained, for example a firming cream, to be dispensed in order to ally the advantages associated with compression and separation of the skin with those of local treatment using cream. Because of the arrangement of the orifice 50, this dispensing can be directly on to the region of the epidermis being treated and simplifies the design of the device 10. Specifically, a case where there is a dispensing orifice 50 on the mobile massage member 16 can require a special-purpose sealing element between the reservoir and the body 12 or alternatively to achieve dynamic sealing. Furthermore, positioning the dispensing orifice 50 between the fixed massage member 14 and the mobile massage member 16 can cause a build-up of cosmetic composition in the space 42, and this would lead to soiling of the device 10.

The example illustrated in FIG. 5, in which elements which are identical to those described with reference to FIGS. 1-3 bear the same references numbers, differs from the examples already described in that the roller 36 of the mobile massage member 16 includes a plurality of fingers 52 formed on its exterior surface and positioned in the form of rows spaced apart in the circumferential direction. Each row of fingers 52 extends axially over the exterior surface of the mobile massage member 14. The fingers 52 of one row can be uniformly axially spaced. The rows in this example are spaced uniformly apart in the circumferential direction. Such fingers 52 additionally can make it possible to obtain from the massaging effect improved cutaneous microcirculation.

Figure 6:
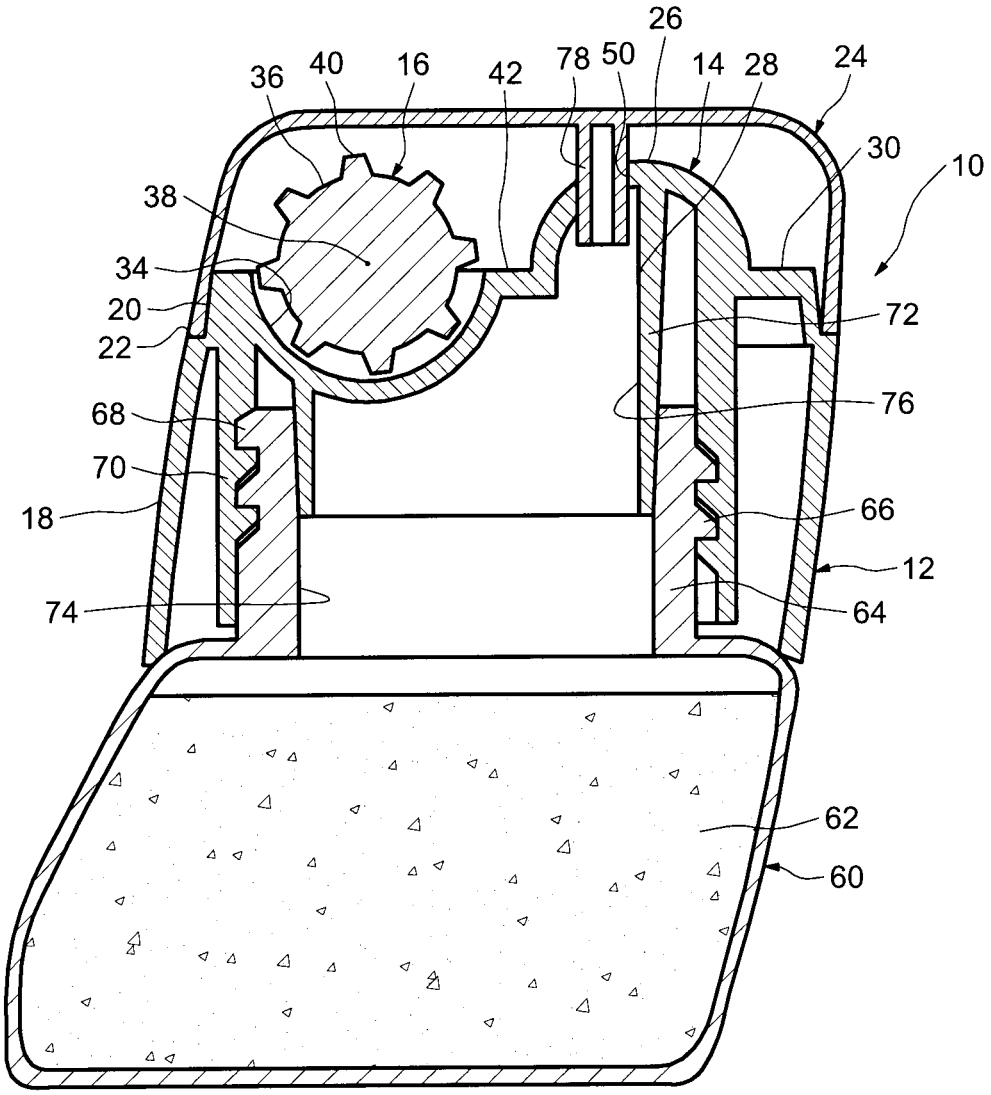
FIG. 6 is a view in cross section of a fourth example massage device.

According to yet another example depicted in FIG. 6, in which elements which are identical to those described with reference to FIGS. 1-3 bear the same references numbers, the device 10 further includes a reservoir 60 filled with a product 62, for example a cosmetic composition, and on which the body 12 is mounted. The reservoir 60 includes a neck 64 provided with an external screw thread 66 designed to collaborate with a screw thread 68 formed in the bore of a first annular skirt 70 of the body 12.

In order to obtain a good seal between the body 12 and the container 60 of the body 12, the latter includes a second skirt 72, an internal one, which fits inside a bore 74 defined by the neck 64. This skirt 72 can also make it possible to delimit an annular space 76 for guiding the product 62 contained in the reservoir 60 towards the dispensing orifice 50. In order to close off the outlet orifice 50 when the cap 24 is mounted on the body 12, a pin 78 is provided on an underside of the cap 24. The pin 78 can limit the risk of product 62 contained inside the container 60 flowing out during storage phases.

It may be possible, in another example, to provide a means that the user can actuate in order to allow or disallow flow of product to the outlet orifice 50, i.e. to have a position in which the product can exit via the orifice 50 and a position in which the orifice is inaccessible to the product.

Figure 7:
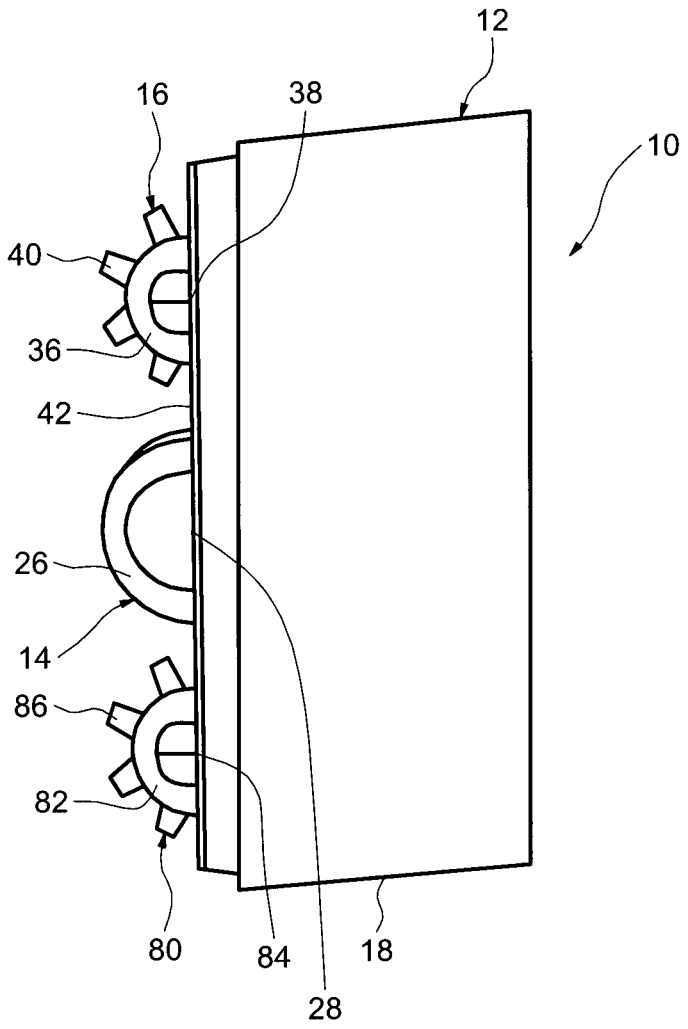
FIG. 7 is a side view of a fifth example massage device.

The example illustrated in FIG. 7, in which elements which are identical to those described with reference to FIGS. 1-3 bear the same references numbers, differs from the embodiment of FIGS. 1 to 3 in that the device 10 further includes a second mobile massage member 80 similar to the first massage member 16. The massage member 80 can be produced in the form of a roller 82 of axis 84 which at each end has journals (not visible) intended to fit into housings provided for this purpose at the frontal surface 30. The roller 82 in this example is produced in the form of a cylinder of revolution. On its exterior surface it has ribs 86 spaced apart in the circumferential direction and constituting a massage surface of the massage member 80 which projects on the surface 30. The layout of the ribs 86 on the roller 82 is identical to that of the ribs 40 on the roller 36 of the massage member 16.

The roller 82 can be mounted to rotate on the body 12 about the axis 84 which is substantially parallel to the axis 38 of the massage member 16. The mobile massage members 16, 80 can be mounted one on each side of the fixed massage member 14. In this example, the massage member 80 is positioned symmetrically with respect to the massage member 16 when considering a plane perpendicular to the surface 30 and containing the axis 28.

When a device 10 such as the one of this example is pressed against the user's skin and moved in the direction of travel perpendicular to the axes 28, 38 and 84, a skin fold is created between the fixed massage member 14 and one of the mobile massage members 16, 80 irrespective of the direction of travel of the device.

According to yet another example that can be seen in FIG. 8, in which elements which are identical to those described with reference to FIGS. 1-3 bear the same references numbers, the mobile massage member 16 includes a roller 36 which has an appreciably bulbous exterior surface and includes a plurality of raised sculpted patterns 94 forming waves running substantially axially over the exterior surface. The sculpted patterns 94 are arranged in the form of rows spaced apart, in the circumferential direction, substantially uniformly. The fixed massage member 14 for its part is produced in the form of a protrusion 92 which can be curved in such a way as to keep the separation between the mobile massage member 16 and the fixed massage member 14 constant.

According to another example visible in FIG. 9, in which elements which are identical to those described with reference to FIGS. 1-3 bear the same references numbers, the device 10 includes a plurality of massage members 100 here produced in the form of a row of balls projecting from the surface 30. In this example, there are four of these balls. Each of the balls is mounted free to rotate in a housing 102 provided for that purpose.

Figure 10:
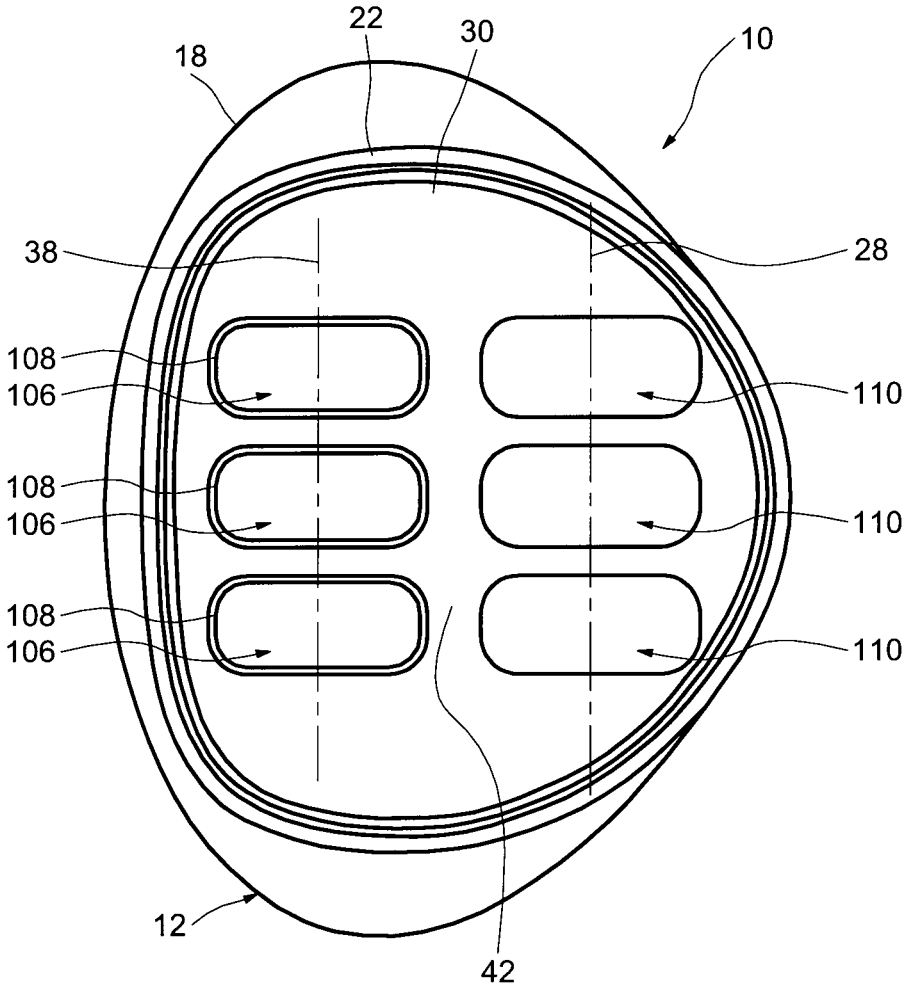
FIG. 10 is a plan view of an eighth example massage device.

In the example illustrated in FIG. 10, the device 10 includes a plurality of massage members 106 here produced in the form of a row of rollers projecting from the surface 30. Associated with each roller is a housing 108. In this example there are three of these rollers mounted free to rotate about their common axis 38. The massage members 106 have a relatively small axial size. The device 10 also includes a plurality of fixed massage members 110 produced in the form of a row of rollers, of axis 28, positioned on the frontal surface 30. The massage members 110 are mounted facing the mobile massage members 106.

Figure 5:
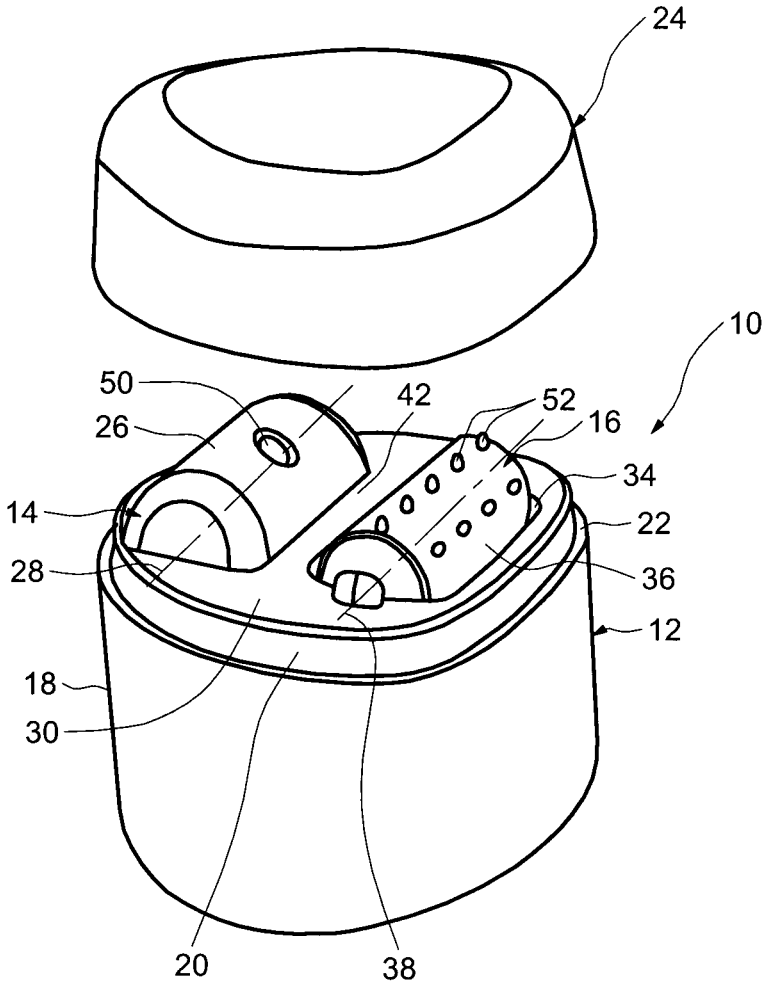
FIG. 5 is a perspective view of a third example massage device.
Figure 8:
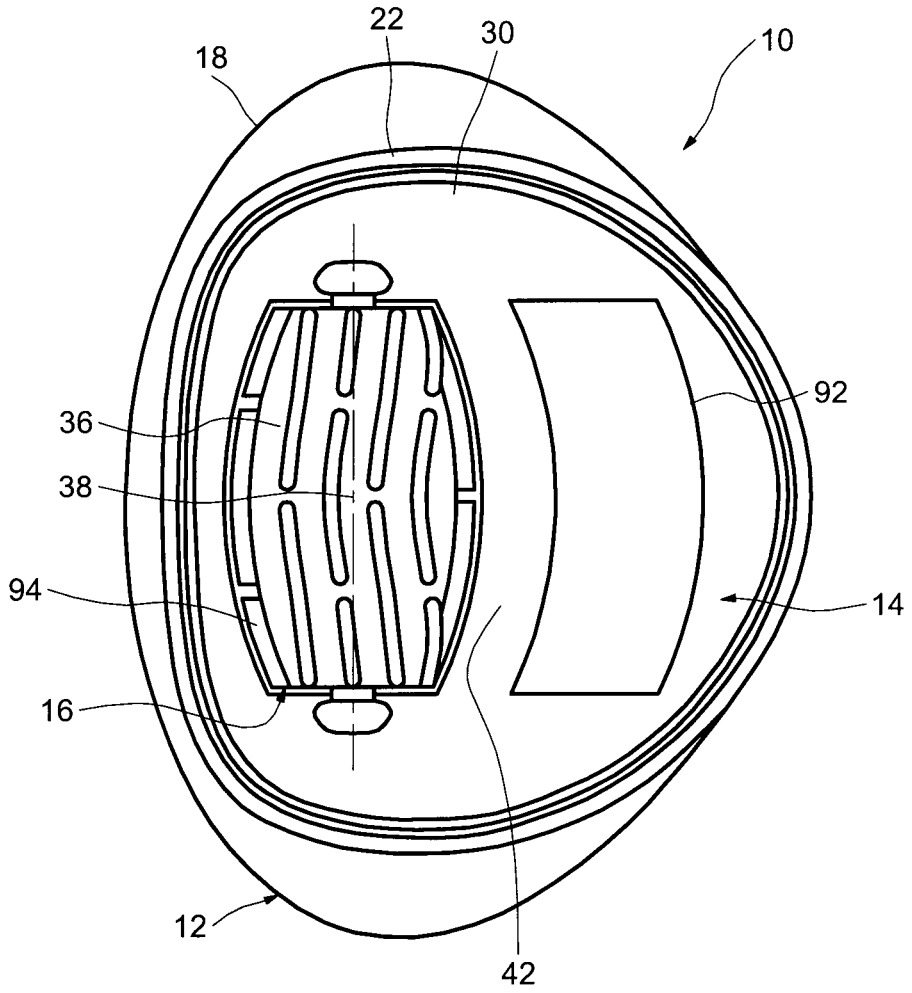
FIG. 8 is a plan view of a sixth example massage device.
Figure 9:
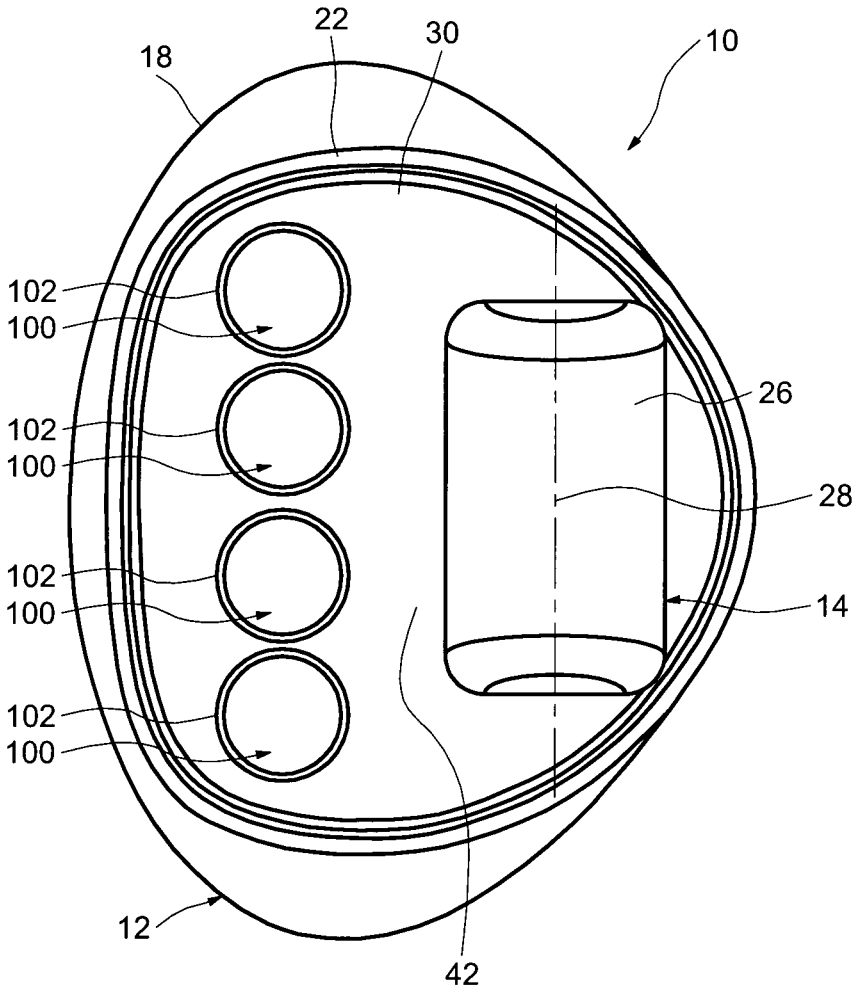
FIG. 9 is a plan view of a seventh example massage device.

Although this is not illustrated in FIGS. 9 and 10, it will be readily understood that the massage members 100, 106 advantageously include raised or projecting elements as illustrated in the embodiment of FIG. 5 or FIG. 8.

Figure 11:
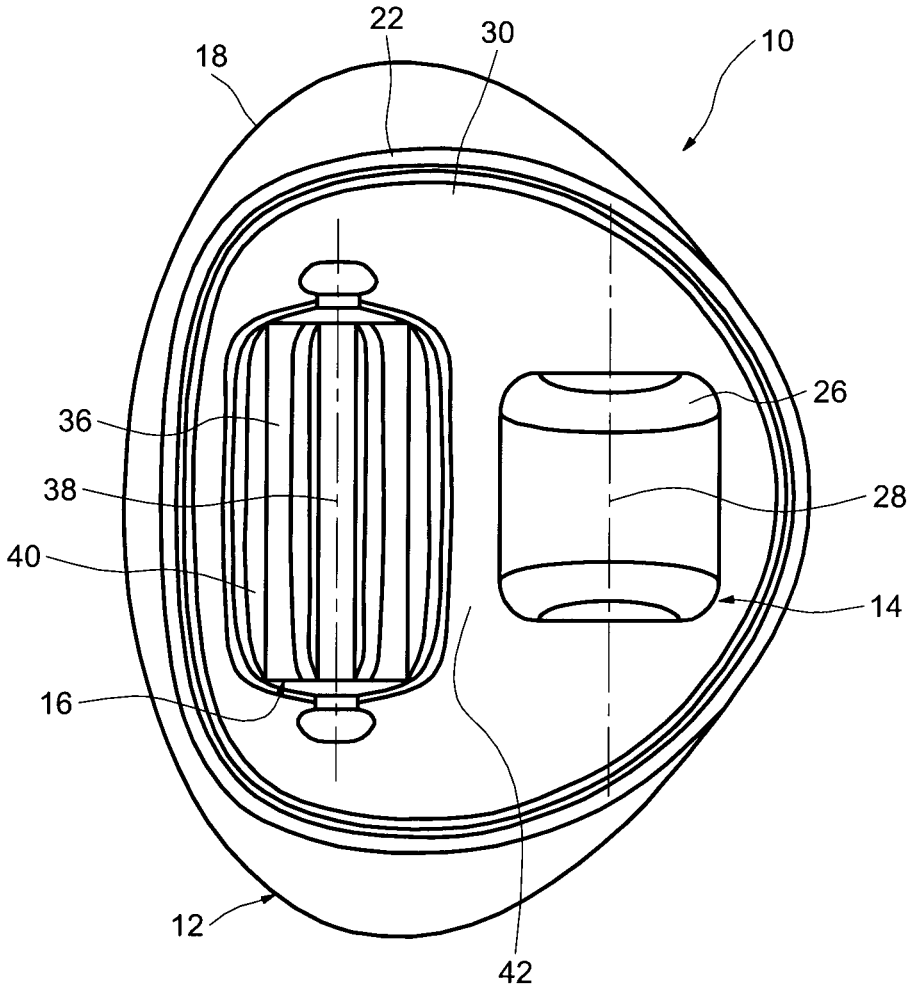
FIG. 11 is a plan view of a ninth example massage device.

The example illustrated in FIG. 11, in which elements which are identical to those described with reference to FIGS. 1-3 bear the same references numbers, differs from the embodiment of FIGS. 1 to 3 in that the half-roller 26 of the fixed massage member 14 is of smaller axial size than the mobile massage member 16.

Figure 12:
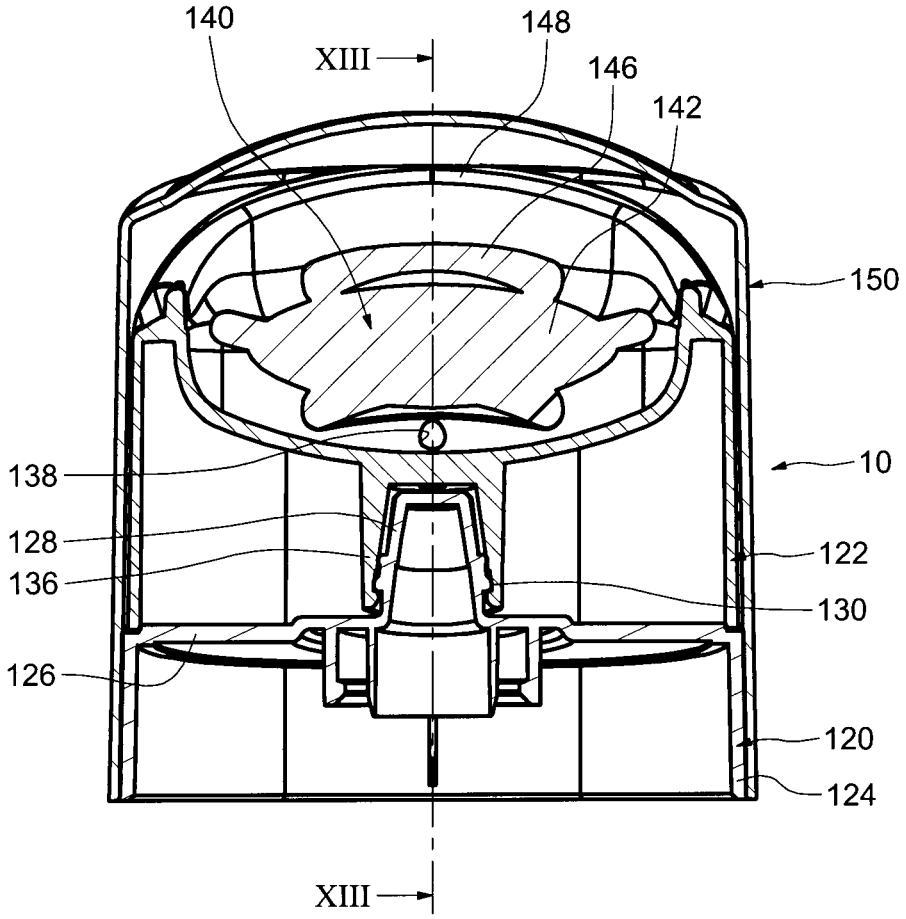
FIG. 12 is a view in partial section of a tenth example massage device.
Figure 13:
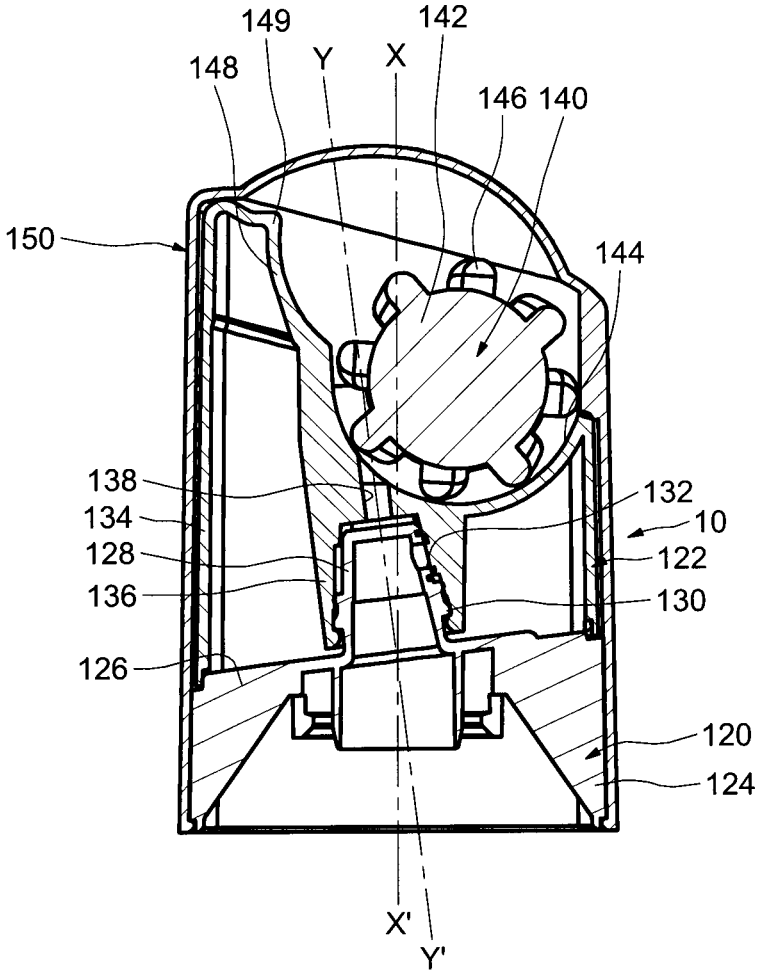
FIG. 13 is a view in section on XIII-XIII of FIG. 12.
Figure 14:
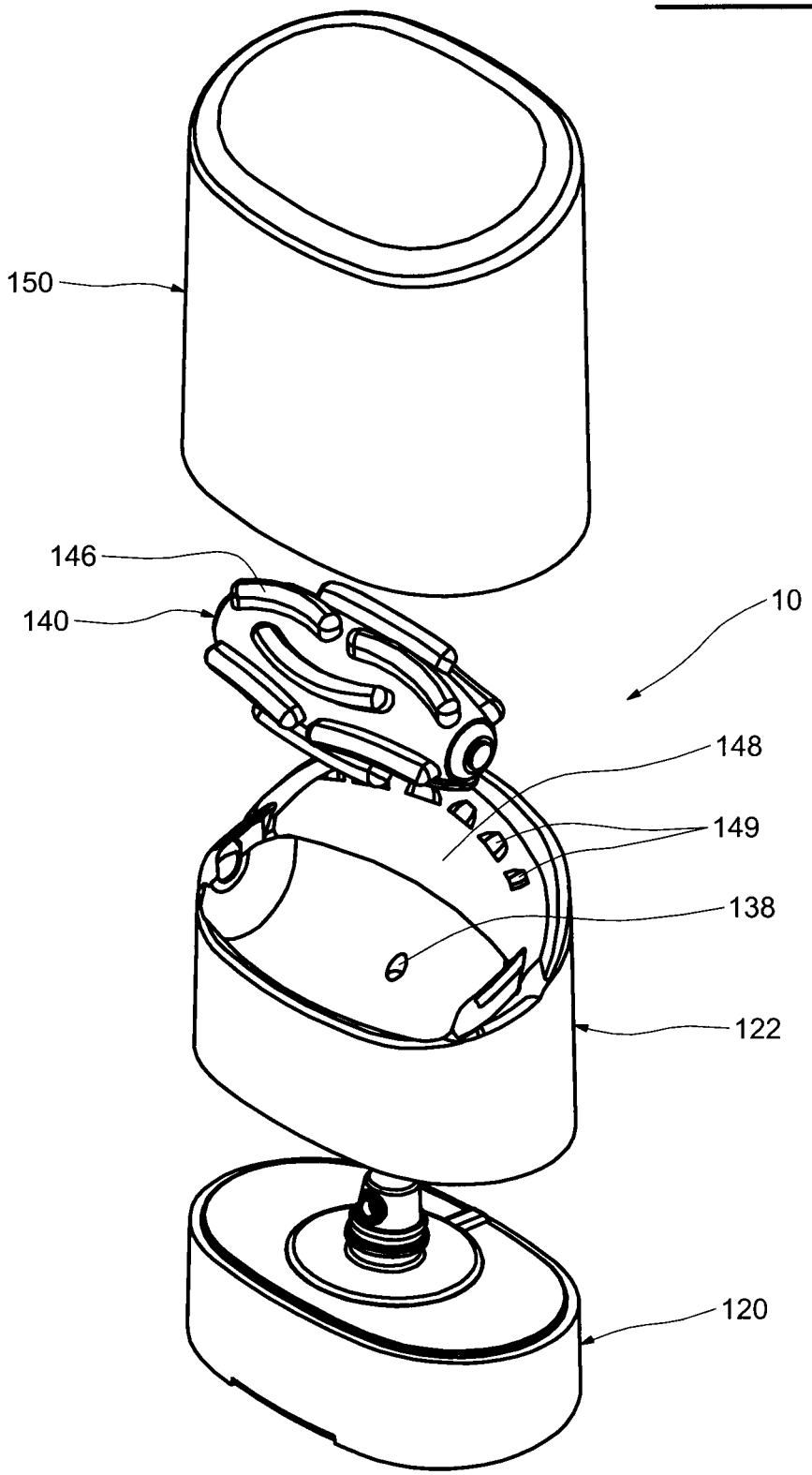
FIG. 14 is an exploded perspective view of the device of FIGS. 12 and 13.

In the example illustrated in FIGS. 12 to 14, the device 10 includes a cosmetic composition dispensing system of the on/off type so that the epidermis can be massaged while at the same time causing the care composition to penetrate this epidermis. In this example, this function is achieved by the inclusion of a first component 120 intended to be fixed by clip-fastening onto a container (not depicted) containing the cosmetic composition and a second component 122 able to be turned with equal facility in one or other direction with respect to the first component 120 about a geometric axis of rotation Y-Y' to allow the cosmetic product to be dispensed. The axis Y-Y' forms an angle of less than 45°, for example an angle of a little under 10° with a vertical axis X-X'. Of course, it will be readily understood that any other on/off system can be used without departing from the scope of the invention.

The first component 120 essentially includes an exterior skirt 124 for attachment to the container and which is extended at an upper end by a radial wall 126 supporting a tubular extension 128 of axis Y-Y'. The extension 128 includes an annular ridge 130 and a lateral opening 132 running perpendicular to the axis Y-Y' for dispensing some cosmetic composition.

The second component 122 for its part includes an exterior skirt 134 surrounding the extension 128 and connected to the radial part 126. The second component 122 also includes an interior skirt 136 able to be fixed to the extension 128 via a rib (not referenced) configured to clip over the ridge 130. The second component 122 is shaped in such a way that, in a closed position, the lateral opening 132 is closed off by the interior skirt 136 so that a dispensing orifice 138 centred on the axis Y-Y' does not communicate with the inside of the container. In order to allow a switch into an open position, the second component 122 has to be turned through half a revolution relative to the first component 120. This rotational movement makes it possible to create a chamber that allows the composition to flow towards the dispensing orifice 138. For further details regarding such a dispensing system, reference may for example be made to patent EP 1 391 393 in the name of the applicant company.

The second component 122 supports a mobile massage member 140 produced in the form of a roller 142 which at each end has journals (unreferenced) intended to fit into housings provided for that purpose in the second component 122 to allow the roller 142 to rotate about its geometric axis. To allow the massage member 140 to be mounted, the component 122 has a recess 144 of concave overall shape. The dispensing orifice 138 opens into the recess 144 so that the massage action and the action causing the cosmetic composition to penetrate the skin can be combined. The roller 142 on its exterior surface has raised sculpted patterns 146 forming waves which extend substantially axially over the exterior surface. The sculpted patterns 146 are spaced apart substantially uniformly in the circumferential direction.

The second part 122 can be configured in such a way as to form, near the mobile massage member 140, a protrusion that forms a fixed massage member 148. The protrusion has an axial size substantially equal to that of the mobile massage member. The fixed massage member 148 includes, near its upper end, projections or ridges 149 directed towards the mobile massage member 140. The ridges 149 are spaced apart and positioned in such a way as to form a transverse row when considering the direction of travel of the device 10 when it is being used.

In a way similar to the examples already described, a space can be formed between the fixed massage member 148 and the mobile massage member 146 so as to allow skin folds to be created as the device 10 is moved over the skin of a user. The existence of the ridges 149 on the fixed massage member and positioned in the converse direction when considering the direction of travel of the device can make it possible not only to improve the hold on the skin but also to create, in addition to the fold or folds between the fixed 148 and mobile 150 massage members, longitudinal folds between the ridges 149 thus forming additional massage means. The ridges 149 can be slightly offset downwards with respect to the top edge of the fixed massage member 148 in order to be able satisfactorily to exert pressure on the user's skin. The device 10 also here includes a closure cap 150 which clips over the first component 120.

Figure 15:
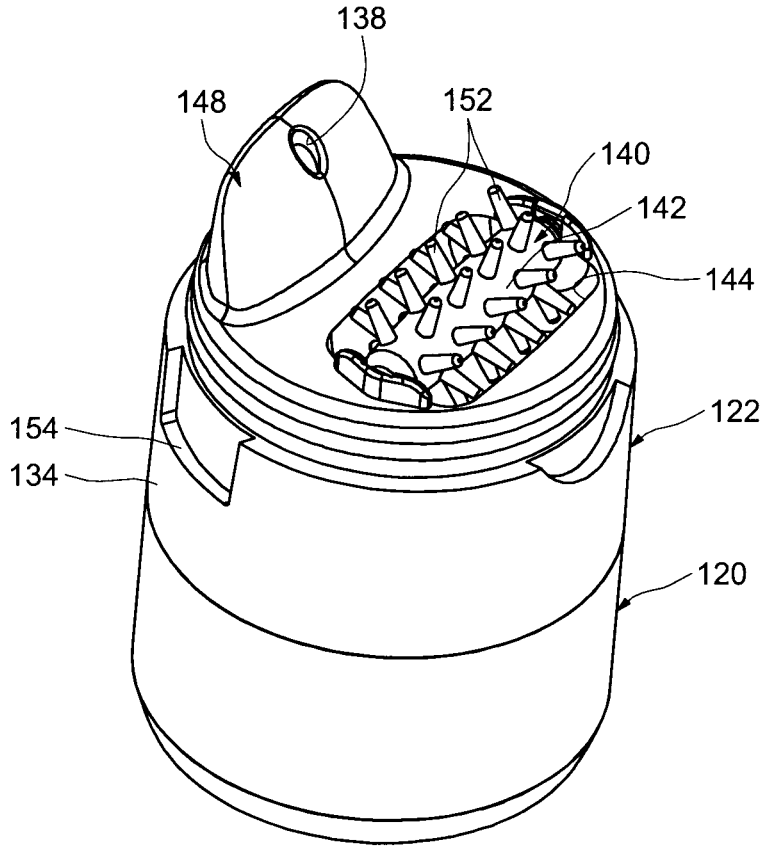
FIG. 15 is a perspective view of a eleventh example massage device.

The example illustrated in FIG. 15 differs from the embodiment already described in that the dispensing orifice 138 is formed on the fixed massage member 148 and in that the mobile massage member 140 includes fingers 152 in place of the sculpted patterns 146. The fingers 152 are arranged on the roller 142 in a similar way to the arrangement of the fingers 52 in the embodiment of FIG. 5. In this example, the fixed massage member 148 has no ridges 149. The second component 122 here includes, at the skirt 134, cut-outs 154 able to collaborate with complementary portions of a closure cap (not depicted) which has a protrusion designed to seal off the dispensing orifice 138.

In all of the examples described hereinabove, the inter-axis distance between the half-roller 26 of the massage member 14 and the roller 26 of the massage member 16 is fixed. However, it will be noted that it is possible, without departing from the scope of the invention, to provide a massage member 16 which is also able to move translationally along the surface 30 of the body 12 in order to have the option of varying this inter-axis distance and of being able, prior to use of the device 10, to adjust it particularly to suit the firmness of that part of the epidermis that is to be treated.

It is also possible to anticipate mounting massage members 14, 16 on the body 12 removeably, for example by clip-fastening, in order to facilitate cleaning but also in order to envisage replacing one or more massage members in order to obtain different massage effects with the same device. Thus, the device can be marketed in the form of a kit containing a number of interchangeable massage members.

By virtue of the invention, there is obtained a device provided with massage members which are able to force the skin in two opposing directions in order to form a plurality of skin folds, so as to obtain a massaging effect both by stretching and by separating the skin with a view effectively to combating the sagging of the tissues of the epidermis.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A massage device intended to be applied to the skin of a user, comprising:

a body comprising a reservoir intended to be filled with a product;

only one fixed massage member that is fixed relative to said body that overall maintains a fixed position with respect to said body when moved over and in contact with the skin, and that adopts the form of a half cylinder which is fixed on an upper frontal surface of the body and projects with respect to said upper frontal surface, an external surface of said fixed massage member forming a massage surface intended to be into contact with the skin; and at least one mobile massage member partially mounted inside a recess formed on the upper frontal surface of the body and that projects with respect to said upper frontal surface, said mobile massage member rotating about an axis of rotation relative to said body when moved over and in contact with the skin and adopting the form of a cylinder, wherein a space is formed on the upper frontal surface of the body between the fixed massage member and the mobile massage member, said space extending longitudinally along said fixed massage member and said mobile massage member, wherein said fixed massage member and said mobile massage member each have an elongated overall shape, wherein the mobile massage member extends longitudinally along its rotation axis and the fixed massage member extends longitudinally along an axis parallel to said rotation axis of the mobile massage member, wherein a fixed longitudinal edge of said fixed massage member faces a longitudinal edge of said mobile massage member, a distance separating said longitudinal edges being constant along the fixed and mobile massage members, wherein said mobile massage member includes reliefs extending axially over an external surface of said mobile massage member with respect to said rotation axis of said mobile massage member and being substantially parallel to the fixed longitudinal edge of the fixed massage member, wherein at least part of the external surface of said fixed massage member that is configured to contact the skin follows a path of at least part of said mobile massage member that is configured to contact the skin so as to cause at least one skin fold to be formed between said fixed massage member and the reliefs of said mobile massage member as said device is moved over and in contact with skin of the user, and wherein at least one product outlet orifice is formed on the external surface of said fixed massage member intended to come into contact with the skin.

2. A device according to claim 1, wherein said reliefs are spaced apart in a circumferential direction on an external surface of said mobile massage member with respect to an axis of rotation of said mobile massage member.

3. A device according to claim 1, wherein the longitudinal edge of said fixed massage member faces the longitudinal edge of said mobile massage member so as to cause the skin fold to be formed between said fixed massage member and said mobile massage member when said device is moved over and in contact with the skin.

4. A device according to claim 1, further comprising a second mobile massage member, wherein said fixed massage member, said mobile massage member, and said second mobile massage member are arranged on said body such that said fixed massage member is mounted between said mobile massage member and said second mobile massage member.

5. A device according to claim 1, wherein the product is a cosmetic product.

6. A device according to claim 1, wherein said body is mounted on said reservoir.

7. A device according to claim 1, wherein one of said fixed massage member or said mobile massage member comprises at least one product outlet orifice.

8. A device according to claim 1, further comprising a closure cap mounted on said body.

9. A device according to claim 8, wherein said closure cap comprises a pin to close off a product outlet orifice.

10. A device according to claim 1, wherein said body and said fixed massage member are formed as a single piece.

11. A massage device according to claim 1, wherein said mobile massage member is able to translate along the upper frontal surface of the body in order to adjust the inter-axis distance between said mobile massage member and said fixed massage member prior to use of said device.

12. A method for massaging the skin using a device according to claim 1, the method comprising:

folding the skin solely by pressing the fixed massage member onto a region of the skin so as to cause the region of the skin to move in a direction of travel of the device, and by rotating the mobile massage member, wherein the reliefs of the mobile massage member cause the region of the skin to move in an opposite direction to the direction of travel of the device.

13. A device comprising:

a body that includes a frontal surface, and includes a reservoir intended to be filled with a product;

only one fixed massage member that is fixed relative to said body, that overall is configured to maintain a fixed position with respect to said body when moved over and in contact with skin of a user and that adopts the form of a half cylinder which is fixed on an upper frontal surface of the body and projects with respect to the upper frontal surface, an external surface of said fixed massage member forming a massage surface intended to be into contact with the skin; and a mobile massage member partially mounted inside a recess formed on the upper frontal surface of the body and that projects with respect to said upper frontal surface, said mobile massage member rotating about an axis of rotation relative to said body and adopting the form of a cylinder, and that includes a plurality of reliefs, wherein a space is formed on the upper frontal surface of the body between the fixed massage member and the mobile massage member, said space extending longitudinally along said fixed massage member and said mobile massage member, wherein said fixed massage member and said mobile massage member each have an elongated overall shape, wherein the mobile massage member extends longitudinally along its rotation axis and the fixed massage member extends longitudinally along an axis parallel to said rotation axis of the mobile massage member, wherein a fixed longitudinal edge of said fixed massage member faces a longitudinal edge of said mobile massage member, a distance separating said longitudinal edges being constant along the fixed and mobile massage members, wherein the reliefs extend axially over an external surface of said mobile massage member with respect to said rotation axis of said mobile massage member and are substantially parallel to the fixed longitudinal edge of the fixed massage member, wherein the external surface of said fixed massage member and said mobile massage member are arranged on said device such that rotational movement of said mobile massage member is configured to draw a fold of skin into a separation space between said fixed massage member and the reliefs of said mobile massage member when said device is moved over and in contact with skin of a user, and wherein at least one product outlet orifice is formed on the external surface of said fixed massage member intended to come into contact with the skin.

14. A device according to claim 13, wherein said mobile massage member is rotatable about an axis of rotation that is fixed relative to said frontal surface of said body such that a peripheral surface of said mobile massage member is movable relative to said frontal surface of said body.

15. A device according to claim 13, wherein the separation space between said fixed massage member and said mobile massage member is substantially equal with respect to a longitudinal direction of said fixed massage member and said mobile massage member.

16. A device according to claim 13, wherein said reliefs of said mobile massage member are arranged such that the skin fold is released as the mobile massage member is further rotated and a second fold of skin of the user is drawn into the separation space between said fixed massage member and said mobile massage member when said device is moved over and in contact with the skin of a user.

17. A device according to claim 13, wherein said reliefs are spaced apart in a circumferential direction on an external surface of said mobile massage member with respect to an axis of rotation of said mobile massage member.

18. A device according to claim 17, wherein said reliefs are arranged in rows spaced equally apart in the circumferential direction on said external surface of said mobile massage member.

19. A device according to claim 17, wherein said reliefs are spaced apart in the circumferential direction on said external surface of said mobile massage member such that the skin fold is released as the mobile massage member is further rotated and a second fold of skin of the user is drawn into the separation space between said fixed massage member and said mobile massage member when said device is moved over and in contact with the skin of a user.

20. A device according to claim 13, further comprising a second mobile massage member, wherein said fixed massage member, said mobile massage member, and said second mobile massage member are arranged on said body such that said fixed massage member is mounted between said mobile massage member and said second mobile massage member.

* * * * *